US006530705B1

(12) United States Patent
Petteruti et al.

(10) Patent No.: US 6,530,705 B1
(45) Date of Patent: Mar. 11, 2003

(54) LABEL PRINTER WHICH HANDLES LABEL STOCK WITH AND WITHOUT PEELABLE LABELS

(75) Inventors: Steven F. Petteruti, East Greenwich, RI (US); Richard J. Preliasco, North Kingston, RI (US)

(73) Assignee: Zih Corp., Wilmington, DE (US)

( * ) Notice: Subject to any disclaimer, the term of this patent is extended or adjusted under 35 U.S.C. 154(b) by 0 days.

(21) Appl. No.: 09/859,759

(22) Filed: May 17, 2001

Related U.S. Application Data

(60) Provisional application No. 60/204,832, filed on May 17, 2000.

(51) Int. Cl.[7] ..... B41J 3/62

(52) U.S. Cl. ..... 400/611; 101/288; 156/247; 156/277; 156/387

(58) Field of Search ..... 400/611, 613; 101/288; 156/247, 277, 387, 541, 542

(56) References Cited

U.S. PATENT DOCUMENTS 4,944,827 A * 7/1990 Lilly et al. ..... 101/288
5,427,460 A * 6/1995 Kajiya ..... 156/541
5,447,379 A * 9/1995 Pou ..... 347/220
5,503,483 A 4/1996 Petteruti et al.
5,713,679 A * 2/1998 Taylor ..... 156/363
6,004,053 A 12/1999 Petteruti et al.
6,010,257 A 1/2000 Petteruti et al.

* cited by examiner

*Primary Examiner*—Andrew H. Hirshfeld
*Assistant Examiner*—Jill E Culler
(74) *Attorney, Agent, or Firm*—Kenneth J. Lukacher; Martin Lukacher

(57) ABSTRACT

A label printer feeds stock having peelable labels or without peelable labels fed by a platen roller against which a print head bears. A bail carrying a bail roller which is latchable in two positions, is provided. In one of these positions, the bail roller is away from the stock so that the stock is fed over a peeler bar, and in the other of the positions, the bail roller wraps the stock around the peeler bar. The latter position is used when the stock has peelable labels and is so called "linered" stock. The print head can print directly on the stock, and the stock having the printed labels is then fed out of the printer. In the second position, the labels are peeled off the stock as it travels around the peeler bar and can be removed by the user while the liner from which the labels have been peeled leaves the printer. No rethreading of stock is required to handle different types of stock, thereby increasing the flexibility and simplifying the operation of the label printer.

12 Claims, 5 Drawing Sheets

LABEL PRINTER WHICH HANDLES LABEL STOCK WITH AND WITHOUT PEELABLE LABELS

This application claims priority to Provisional Application No. 60/204,832, filed May 17, 2000.

DESCRIPTION

The present invention relates to label printers and particularly to a printer which facilitates the use of paper or stock of the type on which labels are printed (so called plain stock) as well as paper or stock which may carry labels which are adhesivably removably connected and are peelable from the liner of the stock (so called linered stock). The stock may also be a continuous web which has peelable labels only in parts thereof and a printer embodying the invention may be readily switched over to handle different parts of the web.

Heretofore it was necessary to rethread the stock in the printer, when linered stock is used, so as to enable the labels to be peeled from the stock by providing a feed path around a peeler bar (which may be a bar or rod which extends across the width of the stock). The present invention provides an improved mechanism for changing the path of the stock so that it passes over the peeler bar when plain stock without peelable labels is used, and when linered stock is used, wraps the stock around the peeler bar while maintaining the tension in the stock so as to facilitate the removal of the labels from the liner and directing the liner out of the printer for disposal. The invention has as its principal feature facilitating and simplifying the use of the printer by enabling it to be used with either linered or plain stock.

Briefly described, the invention is incorporated in a printer having a print head which bears against a platen roller which drives the stock out of an opening in the printer housing over a peeler bar which is disposed in the path of the stock as it leaves the print head. The peeler bar is adjacent to the surface of the platen roller, while being spaced downstream of the platen roller. A bail carrying a roller is pivotally mounted for movement about an axis over the path of the stock and between a first position where the roller is spaced above the path of the stock, and a second position where the roller mounted on the bail is in contact with the surface of the platen roller. The roller moves across the path of the stock and wraps the stock around the peeler bar when in the second position. In the second position the labels are peeled off the liner of the stock as the stock is driven over the peeler bar. The stock does not have to be threaded around the roller. The stock need not be rethreaded to handle linered stock. Tension is maintained in the stock because of the driving engagement thereof between the platen roller and the roller on the bail. A latching mechanism, preferably a hairpin over center spring connected to the bail and to the housing frame, latches the bail in either of its positions to which the bail may be manually pivoted by the user.

The foregoing and other objects, features and advantages of the invention will become more apparent from a reading of the following description in connection with the accompanying drawings in which.

Figure 1:
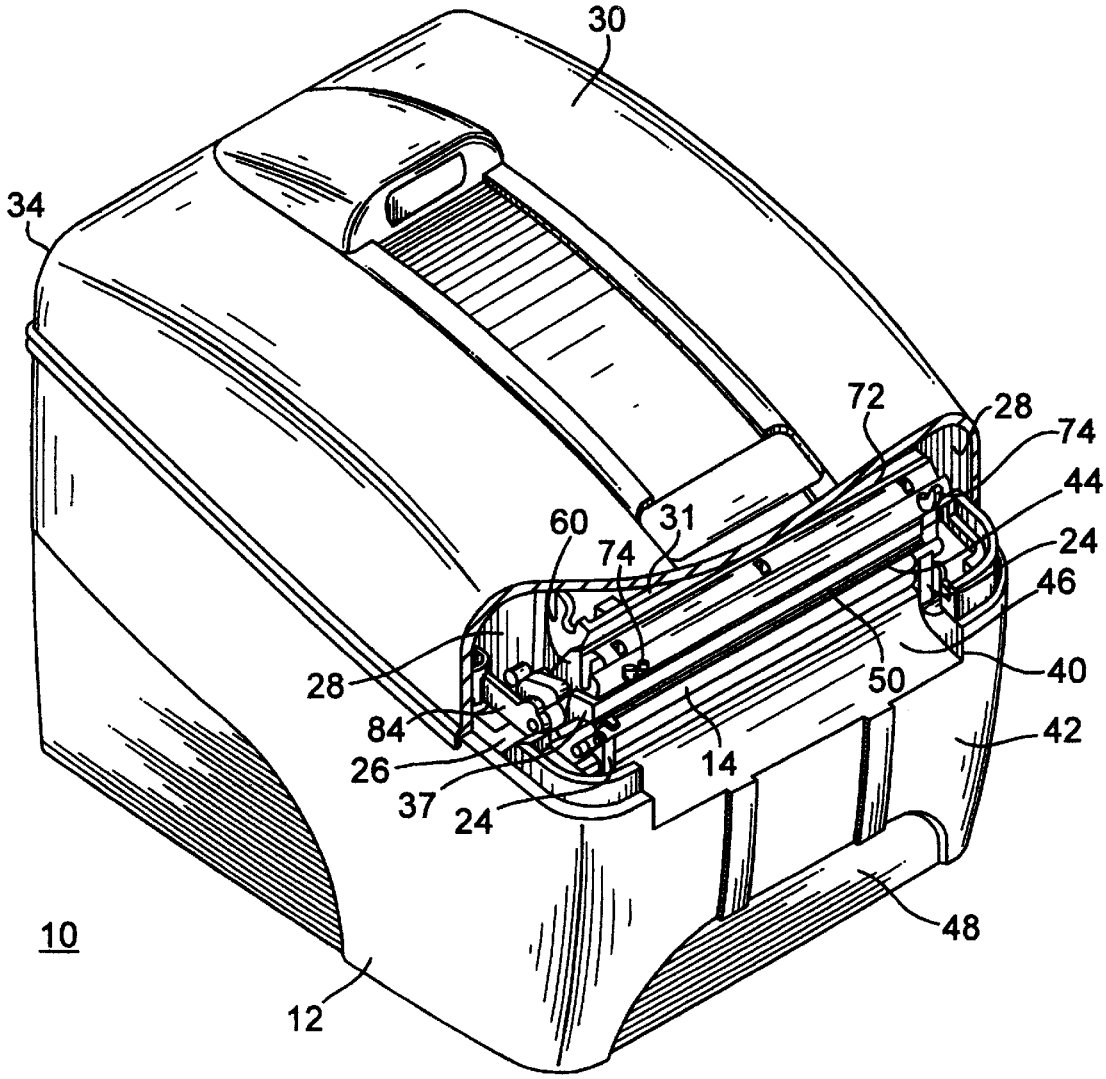
FIG. 1 is perspective view of a printer embodying the improved feeder mechanism according to the invention and showing the bail and roller assembly of the feeder mechanism in an open position for handling plain stock, that is, stock when peelable labels are not used.
Figure 2:
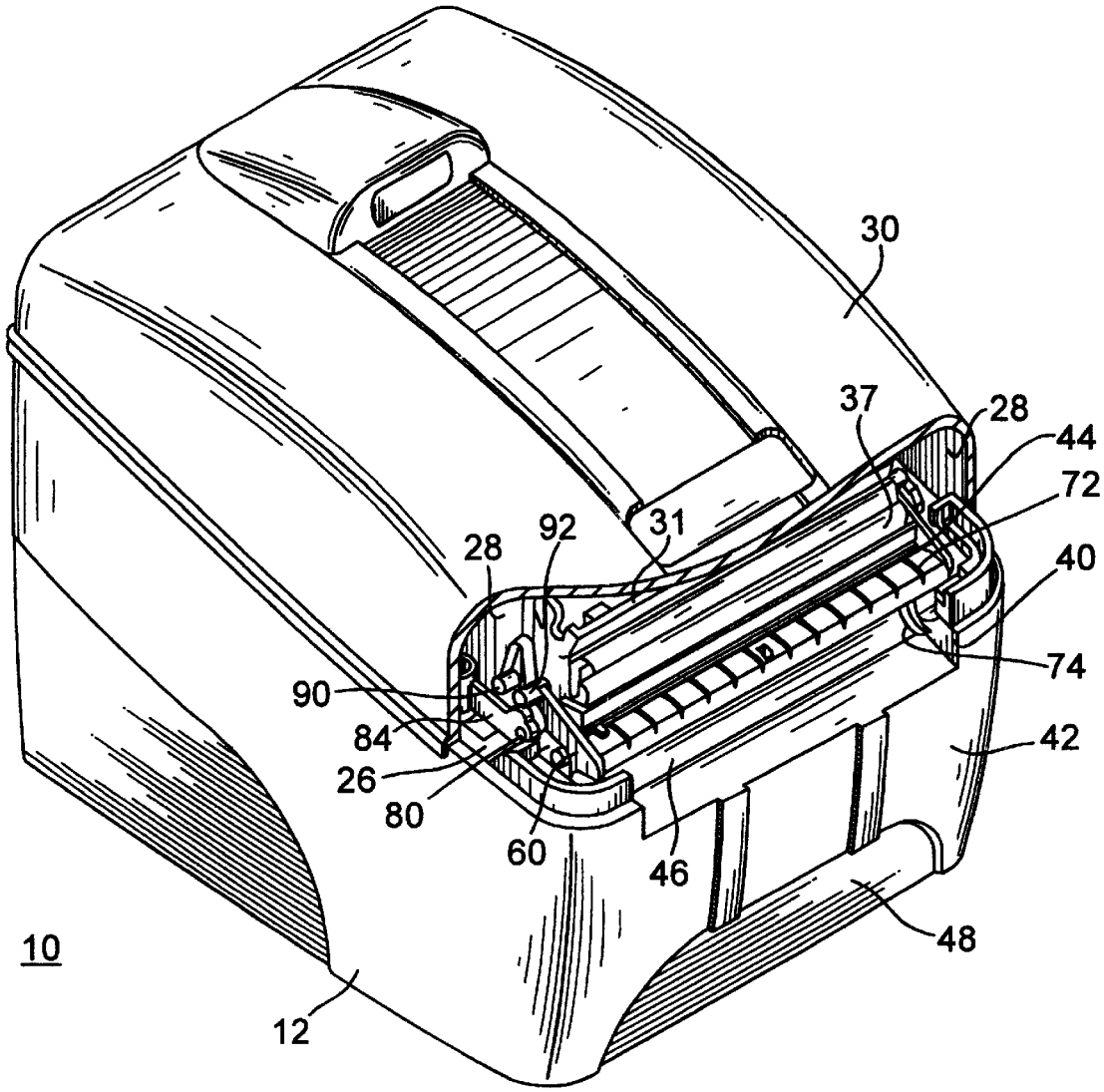
FIG. 2 is a perspective view similar to FIG. 1 but with the bail and roller assembly in closed position for peeling of labels from the liner of the stock.
Figure 3:
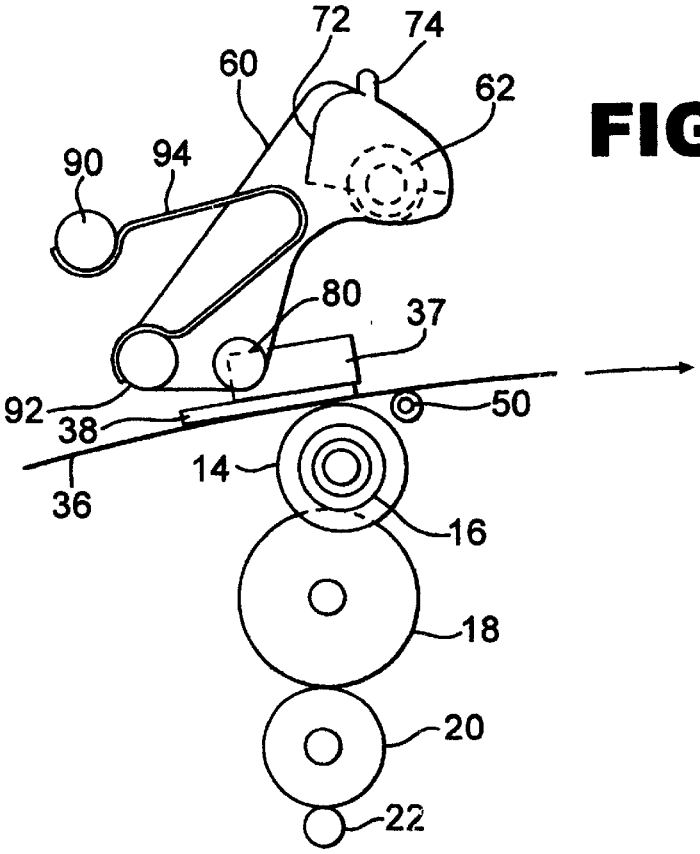
FIGS. 3 and 4 are diagrammatic views showing the feeding mechanism with the bail and roller assembly in position for feeding stock without and with peelable labels, respectively.

Referring to the drawings, FIGS. 1 and 2 show a printer 10 embodying the improved feeder mechanism provided by the invention. The printer is adapted to be used on a desktop and has a base 12 containing a power supply and electronic circuit boards. The base also includes a motor which drives a platen roller 14 via a gear train of gears 16, 18, 20 and 22, as shown in FIG. 3. The gear 22 may be a pinion on the shaft of the motor. The platen roller 14 is journaled in blocks 24 projecting from a frame 26 on the top of the base 12. The frame 26 also has upwardly projecting side walls 28. The side walls are integral with a cross beam 31. The paper stock is contained in a receptacle in the base 12 and is placed therein when a cover 30, pivotally mounted to the base 12 at the rear 34 of the printer, is opened.

The paper 36 is unwound from the roll at the bottom and passes along a path under the cross beam 31 and between the side walls 28. This path extends over the platen roller 14 and under a print head 37. The print head 37 is mounted on a flexure 38 or may be otherwise spring biased against the platen roller 14. The paper 36 is pinched between the print head 36 and the platen roller 14, which may have an exterior sleeve of elastomeric (rubber) material. When the paper 36 enters the nip between the platen roller 14 and the head 37, the paper is fed outwardly of the printer through an exit slot 40 which is provided by a downward notch in the front wall 42 of the base 12 and a complimentary slot in the cover 30.

Alternatively, the frame 26 and all the parts attached thereto, including the print head 37, may be assembled to the cover 30 and pivotable therewith. The platen roller 14 and its journal blocks, then are mounted in the base 12.

The print head 37 may be a thermal print head. Projecting from the front of the print head 37 is a serrated cutter 44 which may be used to cut portions of the paper which provide plain printing stock, after printing thereon. The cutaway parts of the plain stock may be used as labels. When liner stock with peelable labels is used, the liner leaves the printer through the exit opening 40 over a curved guide member 46.

Louvers 48 in a recessed plate accessible at the front wall of the base 12 may be provided to facilitate the passage of cooling air through the base.

A peeler bar 50 in the form of a cylindrical rod is attached in close proximity to the surface of the platen roller 14 by being mounted on the blocks in which the platen roller 14 is journaled. When plain stock is used, as shown in FIG. 3, the path of the stock is over the peeler bar 50 and out through the front exit opening in the printer, where the stock may be grabbed by the user and torn from the remaining stock with the aide of the cutter 44.

Figure 4:
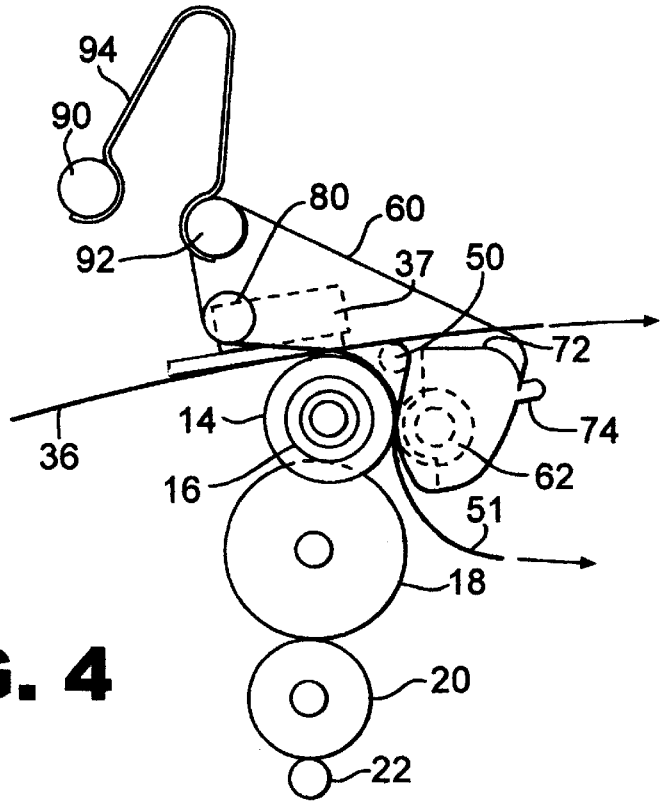
Figure 5:
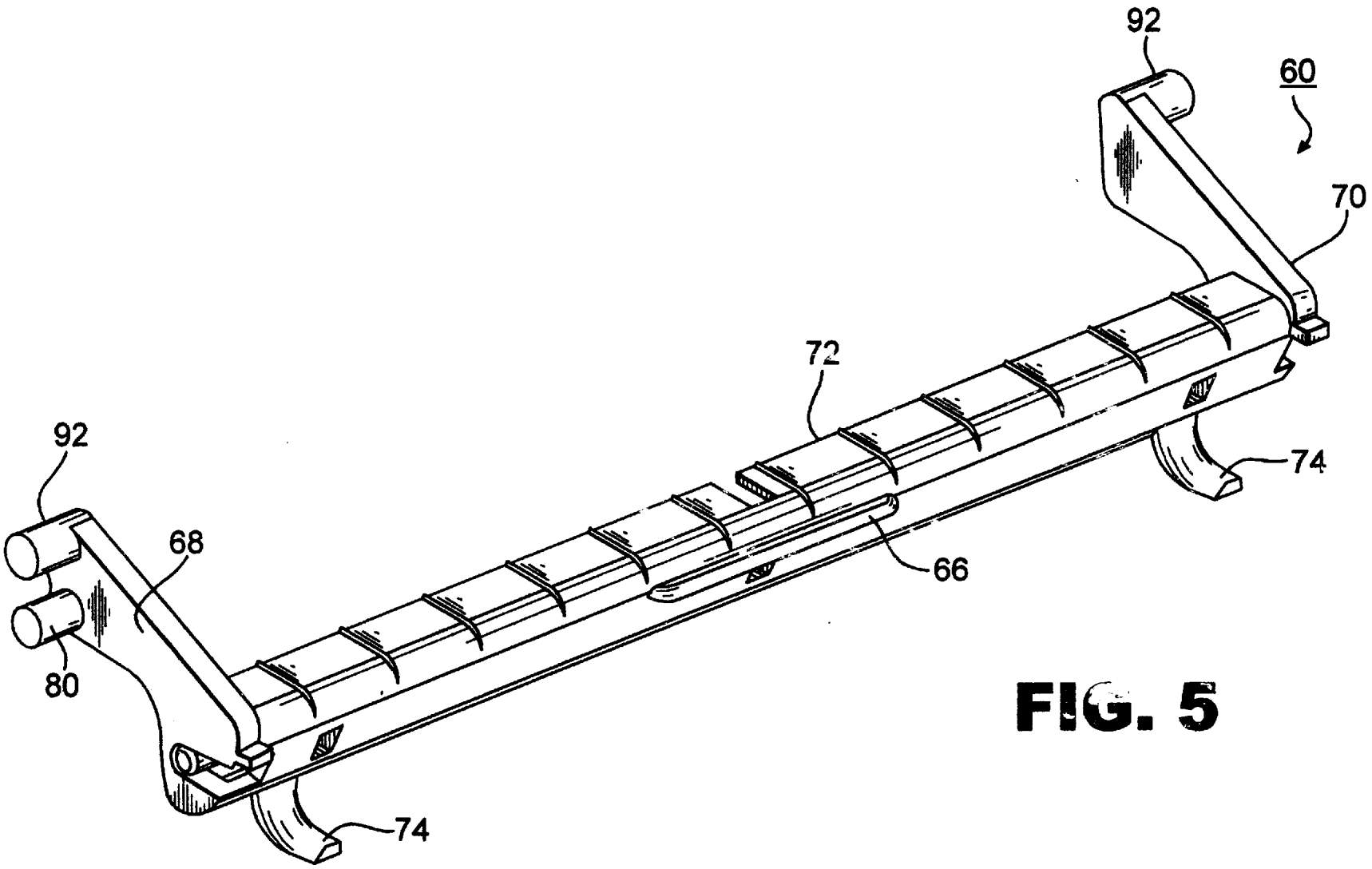
FIGS. 5 and 6 are perspective views of the bail of the roller assembly from the front and rear thereof, respectively.
Figure 6:
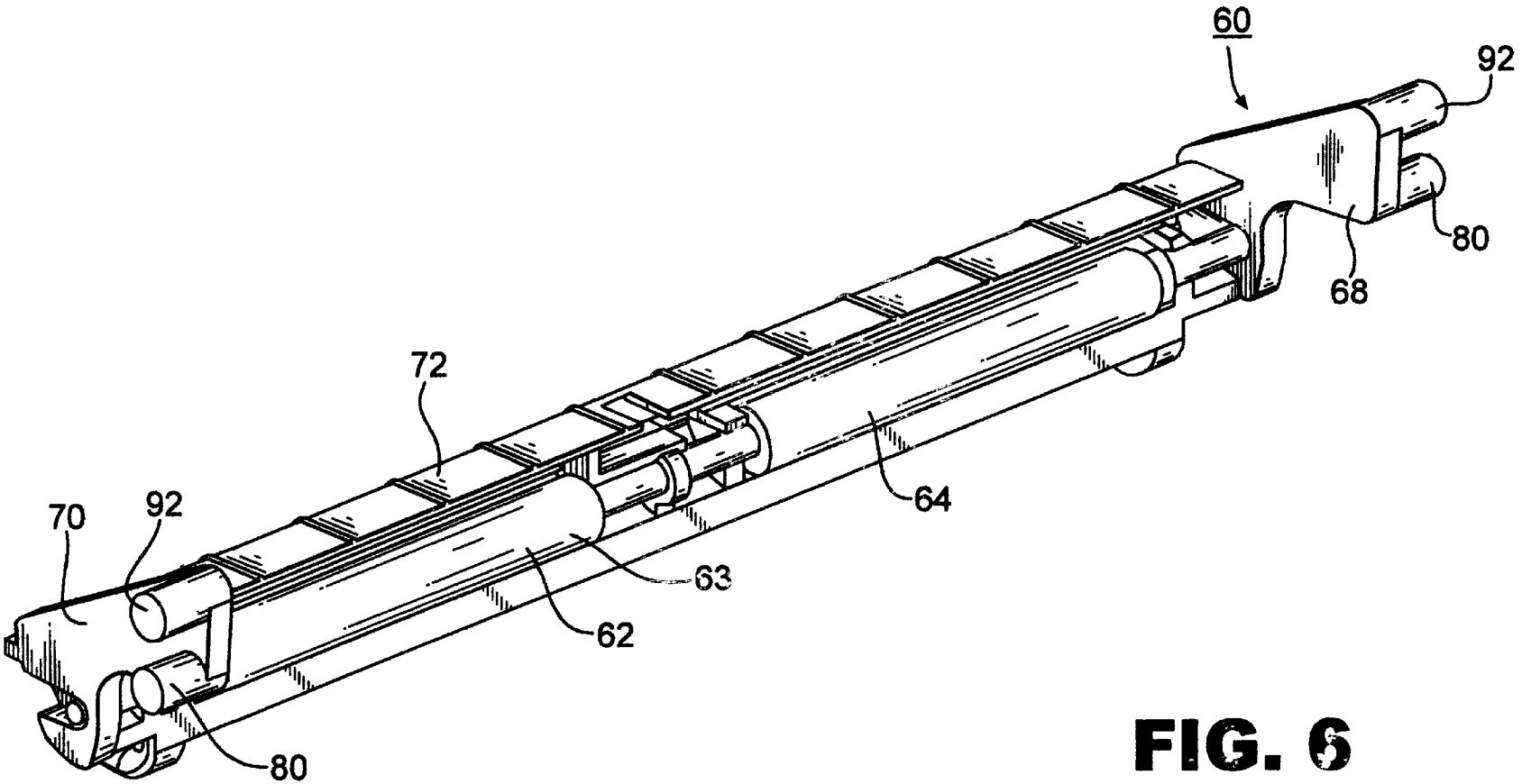

When the stock 36 has a liner with peelable labels thereon, the peeler bar is put into play by wrapping the stock around the peeler bar 50 while maintaining the liner (shown at 51 in FIG. 4) in tension as it travels around the peeler bar 50. To this end a bail 60 is used. The bail contains a roller 62 having a plastic (compressible). The sleeve may be in two sections 63 and 64 (FIG. 6) so as to expose a sensor 66 (FIG. 5) which is positioned to detect the presence of labels which have been peeled off the liner 51. A signal from this sensor to the printer mechanism prevents feeding of more stock until a printed label has been removed from the printer.

The bail roller 62 is journaled in side arms 68 and 70 of the bail. A cross member or bar 72 having ridges, for receiving the peeled label and holding it with a minimum of friction, extends between the side arm 68 and 70, and may be integral therewith, as by being a molded plastic part. Horns 74 extend from the crossbar 72 to enable the user to flip the bail 60 from the position shown in FIG. 3, where the bail roller 62 is away from the path of the stock 36, to the position shown in FIG. 4, where the bail roller 62 is pressed against the platen roller 14 and pinches the liner 51 there between. The latter position may be called the down position while the position shown in FIG. 3 may be called the up or open position or condition of the bail.

In order to maintain the bail in up position or in down position and when in down position to bias the bail roller 62 against the platen roller 14, a latching mechanism is provided. This latching mechanism operates with a stub shaft or pin 80 which is journaled in an opening in bail retainer walls 84 which project forwardly from the side walls 28. One of these retainer walls 84 on the left side of the printer 10 is shown in FIG. 1, while the other is not visible in the figures.

There are two other stub shafts or pins associated with each of the arms 68 and 70 of the bail assembly. Two of pins 90 project laterally from the side walls 28 the others of these pins 92 project laterally from the bail arm 68 and 70. Hairpin springs 94 are captured at ends thereof on the pins 90 and 92. The pins 90 and 92 and spring 94, together with the arms 68 and 70 of the pivotally mounted bail 60, provide an over center latching mechanism which retains the bail either in the up position shown in FIG. 3 or the down position shown in FIG. 4.

In operation, the bail may readily be snapped over from the up position to the down position, or vice versa, depending upon whether stock with peel off labels on a liner or plain stock is to be used or even to shift between sections of stock with and without peelable labels thereon. When the printer is out of stock and the roll is almost completely unwound, it is desirable to leave the bail 60 in the down position so as to facilitate reloading of a new roll of stock.

From the foregoing description it will be apparent that there has been provided a label printer which has been improved in its facility to handle stock with or without peelable labels. Variations and modifications of the herein described printer within the scope of the invention will undoubtedly suggest themselves to those skilled in the art. Accordingly, the foregoing description should be taken as illustrative and not in a limiting sense.

What is claimed is:

1. A label printer for handling stock both with and without peelable labels which comprises a print head and a platen roller forming a nip between which the stock is fed a peeler bar, spaced from said platen roller to define a path for said stock over said peeler bar and a bail having a bail roller pivotally mounted and movable between a first position spaced above said peeler bar and a second position where the stock is engaged by the bail roller against the platen roller downstream of the peeler bar and the stock is wrapped around the peeler bar without rethreading said stock downstream of the peeler bar while maintaining the stock in tension as it is fed by the platen roller over the peeler bar so that labels are released from the stock.

2. The printer according to claim 1 further comprising a latching mechanism for maintaining the bail either in said first or said second position.

3. The printer according to claim 1 wherein said bail has a pivot axis above said peeler bar.

4. A method for peeling labels wherein a peeler mechanism does not require manual threading of stock downstream of a peeler bar in either a peel mode or a non-peel mode, comprising the step of changing a feed path for the stock from a first position over said peeler bar to provide said non-peel mode to a second position wrapped around said peeler bar with the aid of a roller on a pivotable bail by pivoting said bail and carrying said roller across said first position path, thereby providing said peel mode.

5. The method according to claim 4 further comprising the step of automatically latching said bail after the bail is pivoted.

6. The method according to claim 4 wherein said pivoting of said bail is carried out about an axis above said first position path.

7. A label printer for handling linered and unlinered stock and stock which is partially linered and partially unlinered which comprises means for printing on the stock, means for driving the stock in printing relationship with said printing means, a peeler bar downstream of said printing means, and means for selectively guiding said stock along a first path over said peeler bar when unlinered, or a second path wrapped around said peeler bar when said stock is linered, said guiding means comprising a roller engageable with said stock when moved from a first position over said peeler bar to a second position across said first path.

8. The printer according to claim 7 wherein said roller extends across said stock and is pivotally movable about an axis above said peeler bar and said paths.

9. The printer according to claim 8 wherein said roller is part of a bail mechanism.

10. The printer according to claim 9 wherein an over center latching mechanism including a hairpin spring is provided for latching said bail mechanism.

11. The printer according to claim 10 further comprising means for manually moving said bail mechanism.

12. The printer according to claim 11 wherein said moving means comprises fingers extending from said bail mechanism.

* * * * *